US006508541B1

(12) United States Patent
Andrews et al.

(10) Patent No.: US 6,508,541 B1
(45) Date of Patent: Jan. 21, 2003

(54) THIN FRONT CHANNEL PHOTOPOLYMER DROP EJECTOR

(75) Inventors: John R. Andrews, Fairport, NY (US); Narayan V. Deshpande, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/895,682

(22) Filed: Jul. 2, 2001

(51) Int. Cl.[7] ..... B41J 2/05; B41J 2/015
(52) U.S. Cl. ..... 347/65; 347/20
(58) Field of Search ..... 347/63, 65, 64, 347/45, 47, 94

(56) References Cited

U.S. PATENT DOCUMENTS

| | | | | |
|---|---|---|---|---|
| 4,638,337 A | | 1/1987 | Torpey et al. | 347/65 |
| 4,774,530 A | | 9/1988 | Hawkins | 349/63 |
| 4,835,553 A | * | 5/1989 | Torpey et al. | 347/65 |
| 5,119,116 A | * | 6/1992 | Yu | 347/65 |
| 5,278,585 A | | 1/1994 | Karz et al. | 349/65 |
| 6,039,436 A | | 3/2000 | Andrews et al. | 347/62 |
| 6,079,819 A | * | 6/2000 | Desphande et al. | 347/65 |

FOREIGN PATENT DOCUMENTS

| | | | | |
|---|---|---|---|---|
| JP | 6-126961 | * | 5/1994 | 347/65 |

* cited by examiner

*Primary Examiner*—John Barlow
*Assistant Examiner*—Juanita Stephens
(74) *Attorney, Agent, or Firm*—Christopher D. Wait

(57) ABSTRACT

An improved ink jet head wherein an ink reservoir is provided in the ink jet channel. Such a arrangement improves the printhead latency and broadens the range of inks which may be suitably utilized. In one alternative, this ink reservoir is provided between the heater and the face of the printhead and is actually an expansion of the heater pit. In another alternative, this is accomplished by shifting the forward edge of the heater pit as provided in the thick polyimide (or other photopolymer) layer found sandwiched between a heater chip and a ODE channel chip.

15 Claims, 5 Drawing Sheets

FIG. 2
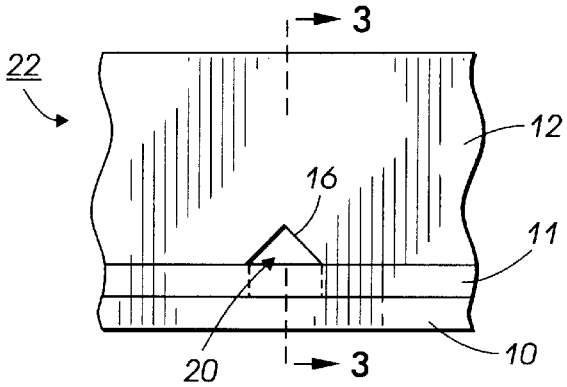
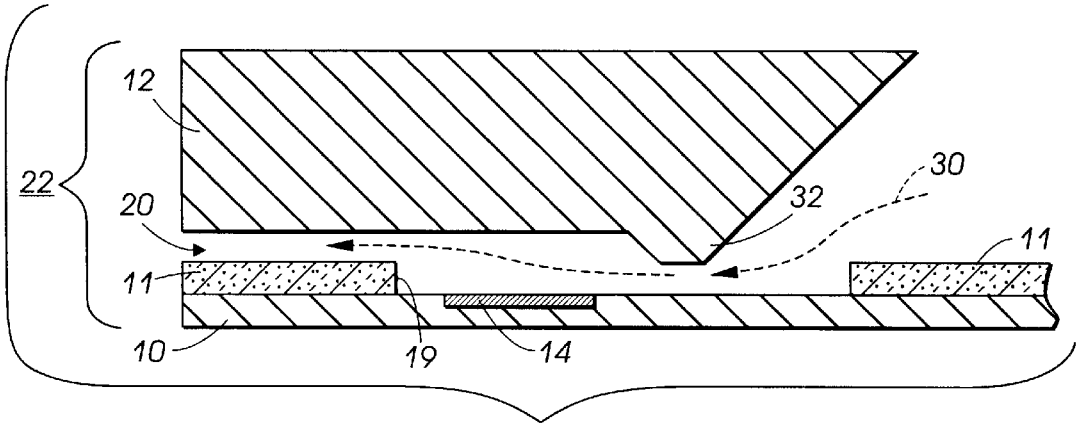
FIG. 3

FIG. 4
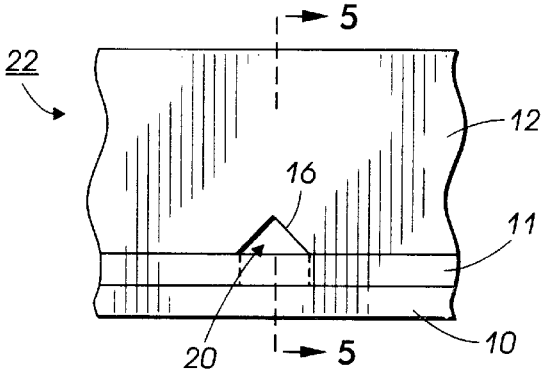
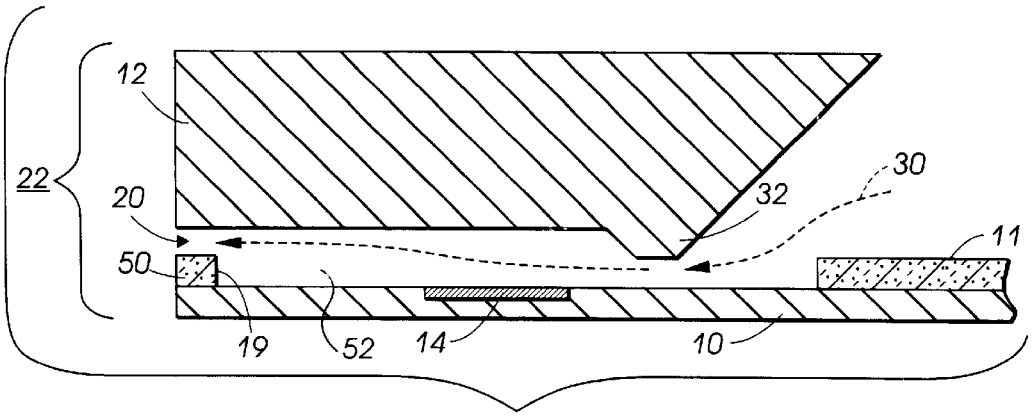
FIG. 5

THIN FRONT CHANNEL PHOTOPOLYMER DROP EJECTOR

BACKGROUND OF THE INVENTION AND MATERIAL DISCLOSURE STATEMENT

The present invention relates to a printhead for a thermal ink jet printer, and more particularly, to a thermal ink jet printer printhead with a drop ejector that uses a short plug at the front edge of a forward extended pit in the thick photopolymer layer which in combination with an orientation dependent etched (ODE) channel forms an improved nozzle therein.

In thermal ink jet printing, droplets of ink are selectively ejected from a plurality of drop ejectors in a printhead. The ejectors are operated in accordance with digital instructions to create a desired image on a print sheet moving past the printhead. The printhead may move back and forth relative to the sheet in a typewriter fashion, or the linear array may be of a size extending across the entire width of a sheet, to place the image on a sheet in a single pass.

The ejectors typically comprise capillary channels, or other ink passageways, which are connected to one or more common ink supply manifolds. Ink is retained within each channel until, in response to an appropriate digital signal, the ink in the channel is rapidly heated by a heating element disposed on a surface within the channel. This rapid vaporization of the ink adjacent the channel creates a bubble which causes a quantity of liquid ink to be ejected through an opening associated with the channel to the print sheet. The process of rapid vaporization creating a bubble is generally known as "nucleation." One patent showing the general configuration of a typical ink jet printhead is U.S. Pat. No. 4,774,530, assigned to the assignee in the present application and herein incorporated by reference in its entirety for its teaching.

It would be desirable to implement a ink jet printhead which allows usage of a greater variety of inks including viscous inks and to also improve the latency of the ink/printhead combination. This would be desirable so as to open up ink property latitudes so as to allow "no-compromise" inks and to reduce the drop volume of thermal ink jet drop ejectors. However, given the need for a heater element and the limited volume amount of ink in the channel, it is only a short matter of time before the ink is dried out in the channel. The amount of time before such drying problems become exhibited is referred to as latency. The longer the latency time for a given head design and ink combination the better. It also follows that improving latency for a given head design will also open up the range of inks which can then be employed by that printhead.

Therefore, as discussed above, there exists a need for a design arrangement which will solve the problem of improving latency in thermal ink jet heads and providing a greater latitude in, and variety of, inks. Thus, it would be desirable to solve this and other deficiencies and disadvantages with an improved ink jet printhead apparatus.

SUMMARY OF THE INVENTION

The present invention relates to a thermal ink jet printhead comprising at least one ejector. The ejector comprises an ink channel, and a reservoir situated within the ink channel.

More particularly, the present invention relates to an improved ink jet printhead apparatus, comprising an ink supply manifold supplying ink to one end of an ink channel having a front face. The apparatus further comprises a heater situated in the ink channel, and a reservoir situated in the ink channel between the heater and the front face.

In particular, the present invention relates to a thermal ink jet printhead comprising at least one ejector with a front face, the ejector comprising a structure defining a channel for passage of ink and a heating element within the channel. The heating element is provided in a substantially rectangular heater pit, the heater pit being provided in a layer of material having a thickness and a front edge associated therewith, the front edge to the front face of the ejector defining a hillock.

BRIEF DESCRIPTION OF THE DRAWINGS

FIG. 2 depicts the front face of the thermal ink jet printhead ejector shown in FIG. 1.

FIG. 3 shows a cross section perspective of the ink jet printhead of FIG. 2.

FIG. 4 depicts the front face of an improved thermal ink jet printhead ejector.

FIG. 5 shows a cross section perspective of the improved ink jet printhead of FIG. 4.

DESCRIPTION OF THE INVENTION

Figure 1:
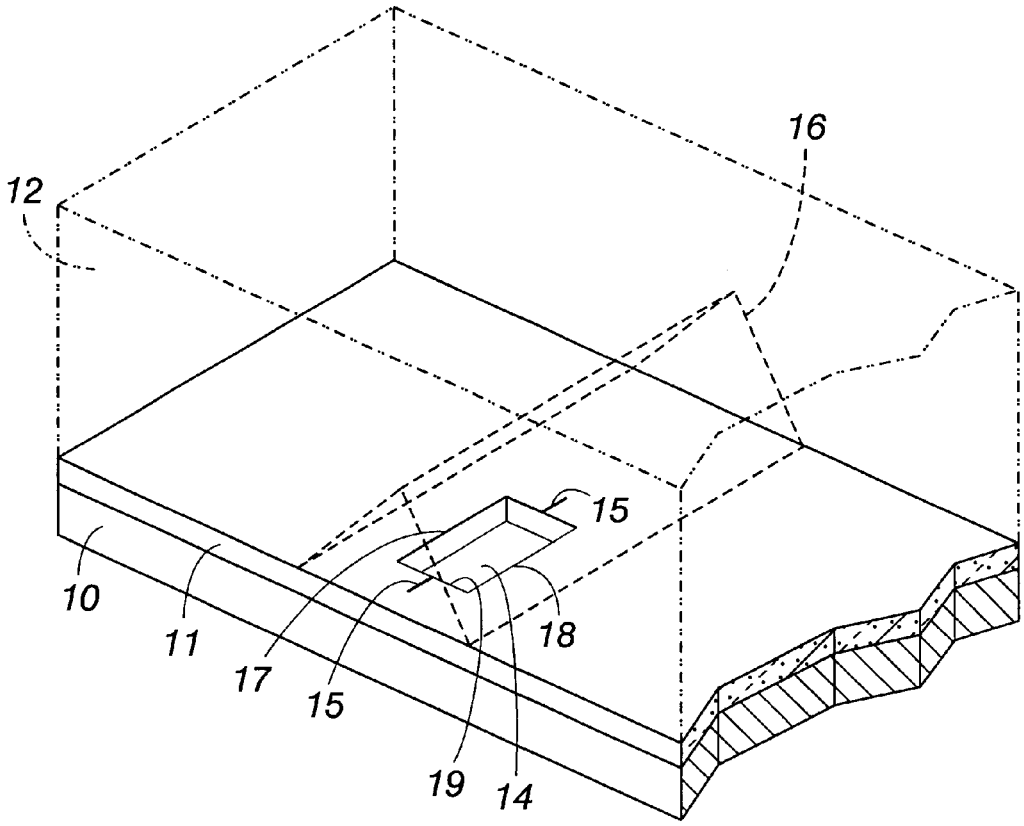
FIG. 1 depicts a highly simplified perspective view showing the portions of an ejector for a thermal ink jet printhead.

FIG. 1 is a highly simplified perspective view showing the portions of an ejector for a thermal ink jet printhead. Although only one ejector is shown, it will be understood that a practical thermal ink jet printhead will include 40 or more such ejectors, typically spaced at 300 to 1200 ejectors per inch. Illustrated in FIG. 1 is the general configuration of what is known as a "side-shooter" printhead wherein the channels forming the ejectors are created within the plane of the two pieces that form the top and the bottom of the drop ejector. The printhead comprises a heater chip 10 including a photopolymer or pit layer 11, which is in turn bound on a main surface thereof to a "channel chip" indicated in phantom as 12. The heater chip 10 is generally a semiconductor chip design as known in the art, and defines therein any number of heating elements, such as generally indicated as 14, in a pit formed in the photopolymer layer 11 with a front edge 19. There is typically provided one heating element 14 for every ejector in the printhead. Adjacent each ejector 14 on the main surface of heater chip 10 is a channel 16 which is formed by a groove in channel chip 12. Channel chip 12 can be made of any number of ceramic, plastic, or metal materials known in the art. In one embodiment, the channel chip 12 is formed using orientation dependent etching (ODE). When the chip 10 is abutted against the channel chip 12, each channel 16 forms a complete channel with the adjacent surface of the heater chip 10, and one heating element 14 disposes a heating surface on the inside of the channel so formed, as shown in FIG. 1. Although the channel and exit nozzle shown in FIG. 1 are triangular in shape due to the action of the ODE etching process, it will be apparent to those skilled in the art that other embodiments can have some or all of the channel structure formed in the photopolymer layer to form an essentially rectangular cross-section.

In operation, an ink supply manifold (not shown) provides liquid ink which fills the capillary channel 16 until it is time to eject ink from the channel 16 onto a print sheet. In order to eject a droplet of ink from channel 16, a voltage is applied to heating element 14 in heater chip 10. As is familiar in the art of ink jet printheads, heating element 14 is typically polysilicon which is doped to a predetermined sheet resistivity. Because heating element 14 is essentially a resistor, heating element 14 dissipates energy in the form of heat, thereby vaporizing liquid ink immediately adjacent the heating surface. This vaporization creates a bubble of ink vapor within the channel, and the expansion of this bubble in turn causes liquid ink to be expelled out of the channel 16 and onto a print sheet to form a spot in a desired image being printed. As shown in the view of FIG. 1, it is intended that the ink supply manifold be disposed behind the printhead, so that the ejected ink droplet will be ejected out of the page according to the perspective of FIG. 1.

FIG. 1 shows a highly simplified version of a practical thermal ink jet printhead, and any number of ink supply manifolds, intermediate layers, etc., which are not shown, would be provided in a practical printhead. However, it is apparent from FIG. 1 that the heating element area formed by heating element 14 effectively exposed within channel 16 is substantially rectangular, and two of the four edges of the heating element area are associated with conductors, indicated as 15, which are used to supply energy to the heating element 14. Further, these conductors 15 are disposed in effect parallel to the direction of ink movement through channel 16. In the present description, the edges of heating element 14 which are not associated with conductors 15 are called first and second "lateral" edges and indicated as 17 and 18 respectively. The heating element 14 is preferably polysilicon which is uniformly doped from a first lateral edge 17 to the second lateral edge 18, all the more to achieve a uniformity of resulting heat generation across the heating element 14.

FIG. 2 is a depiction of the front face 22 of the thermal ink jet printhead ejector shown in FIG. 1. It is comprised of heater chip 10, the photopolymer or polyimide pit layer 11 and channel chip 12. The front face 22 is typically created when the printhead is diced from the forming wafers. The dicing is arranged so as to cut through the channel 16 and thereby terminate the channel 16 and thereby create the printhead orifice or droplet emitting nozzle 20.

In FIG. 3, there is provided a schematical cross-sectional perspective of the printhead provided in FIG. 2. The general ink flow path for printing is, as indicated by arrows 30 and passes under the bypass plug 32, over heater element 14, and over front edge 19 to exit at the emitting nozzle 20 on the front face 22 of the thermal ink jet printhead. A heater element 14 is typically arranged in the heater chip 10 so as to be located between the front edge 19 and the bypass plug 32. Further explanation and discussion of such thermal ink jet printheads is found in U.S. Pat. No. 4,638,337 to Torpey et al. which is hereby incorporated by reference in its entirety for its teaching.

FIG. 4 shows the front face of a thermal ink jet printhead which for all appearances is identical to that provided in FIG. 2. However, cross-sectioning at section line 5 yields the device depiction found in FIG. 5. As can be seen in FIG. 5 with regards to photopolymer layer 11, the front edge 19 has been shifted away from the heater element 14 and thereby much closer to the front face 22 to effectively increase the heater pit size and volume. This creates a hillock 50 which may be as much as nearly 50 microns wide, or more optimally as little as 10 microns wide, where such width is measured from the front edge 19 to the front face 22.

Figure 6A:
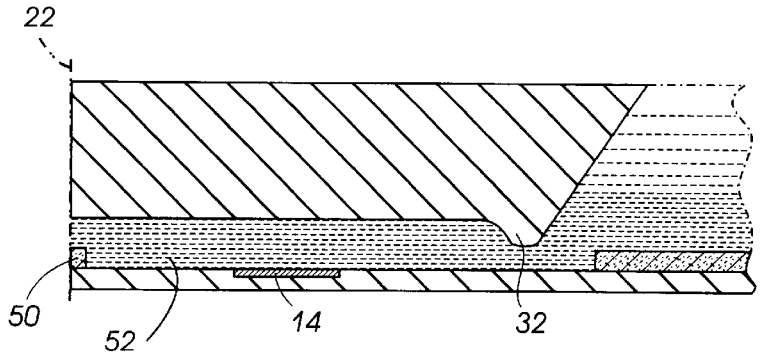
FIGS. 6*a–f* depict schematical simulation results for the improved ink jet printhead as provided in FIG. 5
Figure 6B:
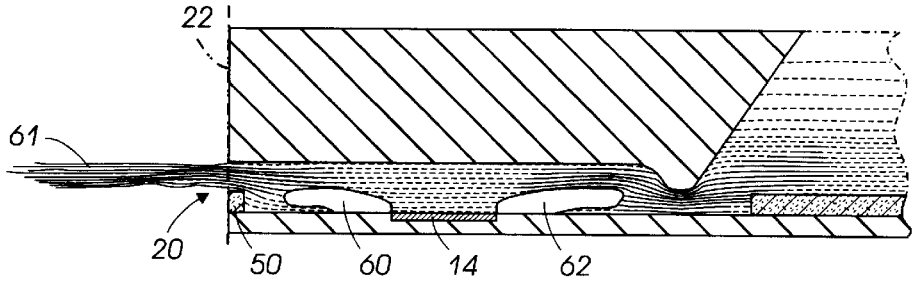
Figure 6C:
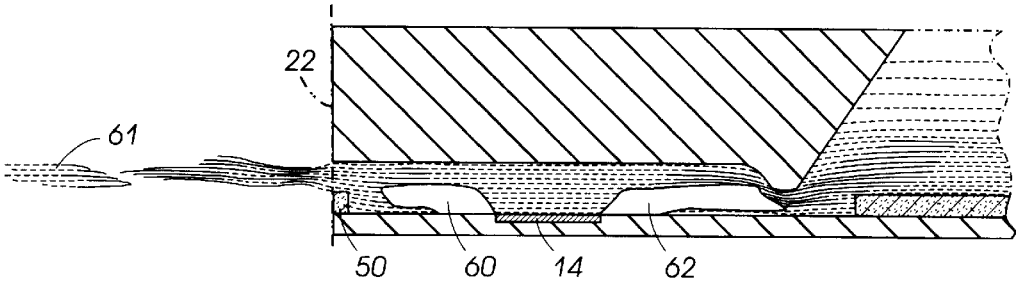
Figure 6D:
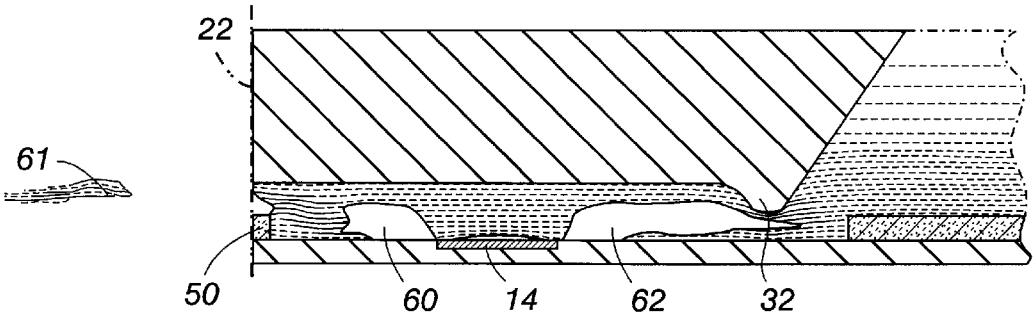
Figure 6E:
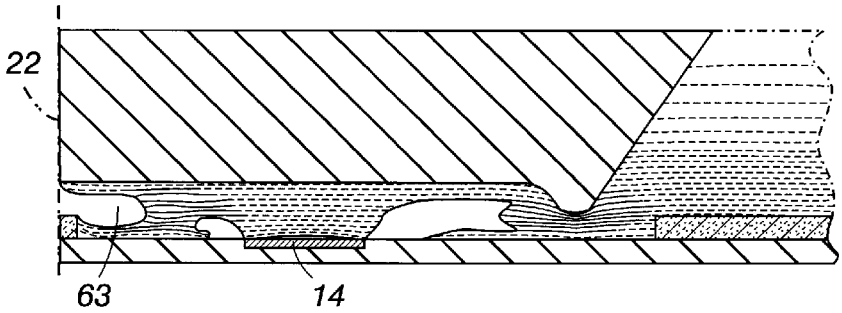
Figure 6F:
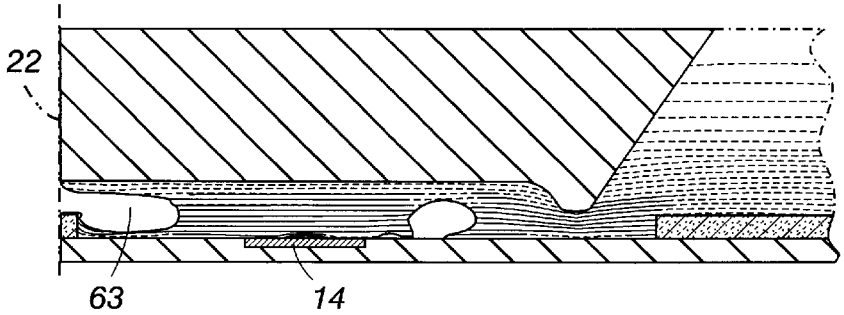

FIGS. 6*a–f* schematically depict fluid mechanical simulation results for different times following the onset of boiling for an ink jet printhead arrangement as per the invention described above. FIG. 6*a* shows the stasis conditions at time zero. In FIG. 6*b*, sufficient current has been applied to heater 14 to cause a steam bubble to erupt. In fact, at this point of time at 4.99 microseconds into the simulation, as shown in FIG. 6*b*, the bubble grows to the front and back. The front part of the bubble 60 is driving a stream 61 of ink past the front face 22 and hillock 50, through the nozzle 20. The back part of the steam bubble 62 is pushing some of the ink back to the ink supply though impeded by bypass plug 32. FIG. 6*c* displays the advancement of the stream 61 at a later moment of time in the simulation and that the rearward part of the steam bubble 62 has reached the bypass plug 32 and is being further impeded. In FIG. 6*d*, the last of the stream 61 is depicted as ending and the beginning of recovery back to stasis has begun. This is more clearly evident in FIGS. 6*e* and 6*f* where an ingress of air 63 is manifest. One concern with a short wall of photopolymer in the front channel such as is provided with hillock 50 is the possibility of air ingestion by the expanding bubble. As can be seen from the above described simulations the bubble stays confined to the long pit section and no ingestion occurs. What will be apparent to one skilled in the art is that the effective enlargement of the heater pit has improved the performance of the ink jet printhead by providing a lower impedance line to the ink flow toward the nozzle 20.

While the invention has been described in terms of shifting the front edge 19 so as to create a hillock 50, the teaching of the invention may be more correctly expressed as creating a reservoir 52 of ink in the channel 16, and more particularly, one which is forward of the heater element 14. There are two primary benefits to such an arrangement, first the latency of the printhead is improved because the volume of ink subject to drying is increased thereby increasing the time before dry-out occurs; and secondly the operation of ejecting the ink droplets is enhanced because in essence the effective impedance for the flow of ink or ink bubble from the heater to the nozzle has been reduced. However, there are constraints to achieving such a goal. For example, the heater pit could have been enlarged by shifting outward the first and second lateral edges 17 and 18 as found in the photopolymer layer. But there is a necessary pitch constraint for each nozzle which must be respected in order to satisfy the dots per inch specification required to achieve a given printing resolution requirement. Spreading of the lateral edges could lead to violating that pitch constraint and is therefore a less preferred approach than that described above.

In summary, by sifting the forward edge of the heater pit found in an ink jet printhead a greater reservoir of ink in the channel can be maintained which will improve the latency for that printhead. This can be achieved not only without adverse affect to the printhead but can actually improve the operation by reducing the impedance to the ink at ejection. Such improvements can also allow a greater number of ink types to be utilized.

While the embodiments disclosed herein are preferred, it will be appreciated from this teaching that various alternative, modifications, variations or improvements therein may be made by those skilled in the art, which are intended to be encompassed by the following claims.

What is claimed is:

1. A thermal ink jet printhead comprising at least one ejector, the ejector comprising:

an ink channel with a front face;

a heater pit within the ink channel;

a heater in the heater pit; and, a reservoir situated within the ink channel between the heater and the front face, the reservoir conjoined with the heater pit.

2. The thermal ink jet printhead of claim 1 wherein the reservoir and the front face define a hillock.

3. The thermal ink jet printhead of claim 2 wherein the hillock as defined by the reservoir and front face is from 10 to 49 microns in width.

4. The thermal ink jet printhead of claim 3 wherein the hillock is 10 microns or less in width.

5. The thermal ink jet printhead of claim 1 wherein the reservoir is a heater pit having a front edge where the front edge is shifted toward the front face so as to define a hillock.

6. The thermal ink jet printhead of claim 5 wherein the hillock as defined by the front edge and front face is from 10 to 49 microns in width.

7. An improved ink jet printhead apparatus, comprising:

an ink supply manifold supplying ink to one end of an ink channel having a front face;

a heater pit within the ink channel;

a heater in the heater pit; and, a reservoir situated in the ink channel between the heater and the front face; the reservoir conjoined with the heater pit.

8. The improved ink jet printhead apparatus of claim 7 wherein the reservoir and the front face define a hillock.

9. The improved ink jet printhead apparatus of claim 8 wherein the hillock is in dimension as defined by the reservoir and front face from 10 to 49 microns in width.

10. The improved ink jet printhead apparatus of claim 8 wherein the hillock as defined by the reservoir and front face is from 10 or less microns in width.

11. The improved ink jet printhead apparatus of claim 8 wherein the ink channel is formed using ODE.

12. The improved ink jet printhead apparatus of claim 8 wherein the ink channel is formed in a photopolymer.

13. The improved ink jet printhead apparatus of claim 8 wherein the heater is provided in a heater pit and the reservoir is formed as an extension of the heater pit.

14. The improved ink jet printhead apparatus of claim 13 wherein the heater pit is formed in a layer of photopolymer.

15. The improved ink jet printhead apparatus of claim 13 wherein the heater pit is formed in a layer of polyimide.

* * * * *